United States Patent [19]

Oshiro

[11] 4,019,555

[45] Apr. 26, 1977

[54] WINDOW WITH VENTILATING CAPABILITY

[76] Inventor: Seiri Oshiro, 27-banchi 7, Kyohara, Naha, Okinawa, Japan

[22] Filed: Nov. 12, 1975

[21] Appl. No.: 631,333

[30] Foreign Application Priority Data

| | | |
|---|---|---|
| Nov. 15, 1974 | Japan | 49-132334 |
| Aug. 19, 1975 | Japan | 50-114664 |
| Sept. 4, 1975 | Japan | 50-122603 |

[52] U.S. Cl. ..... 160/371

[51] Int. Cl.[2] ..... E06B 5/00

[58] Field of Search ..... 160/371, 179, 87, 181, 160/130; 98/88 S, 40 VM

[56] References Cited

UNITED STATES PATENTS

| | | | |
|---|---|---|---|
| 2,337,326 | 12/1943 | Hardy | 160/179 |
| 2,837,153 | 6/1958 | Brown et al. | 160/371 |
| 3,143,165 | 8/1964 | Lewis et al. | 160/371 X |
| 3,292,349 | 12/1966 | Cuta | 160/371 X |
| 3,553,942 | 1/1971 | Harrington et al. | 160/371 X |

FOREIGN PATENTS OR APPLICATIONS

| | | | |
|---|---|---|---|
| 8,409 | 1/1910 | United Kingdom | 160/179 |

*Primary Examiner*—Philip C. Kannan
*Attorney, Agent, or Firm*—Frank J. Jordan

[57] ABSTRACT

A window with a ventilating capability that does not decrease the insulating effect includes a window sash on which there are disposed at regular spaced intervals a plurality of screens between which are formed insulating air layers.

5 Claims, 44 Drawing Figures

FIG. 4B
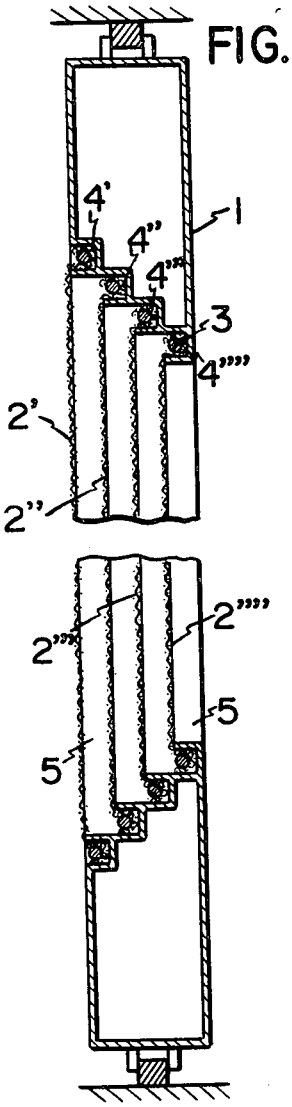
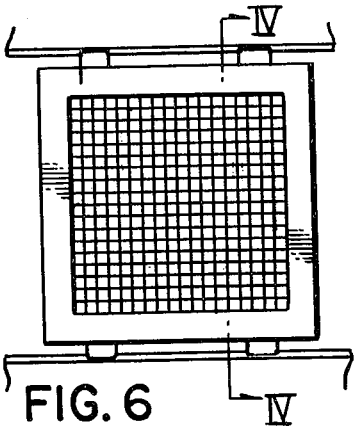
FIG. 6
FIG. 7
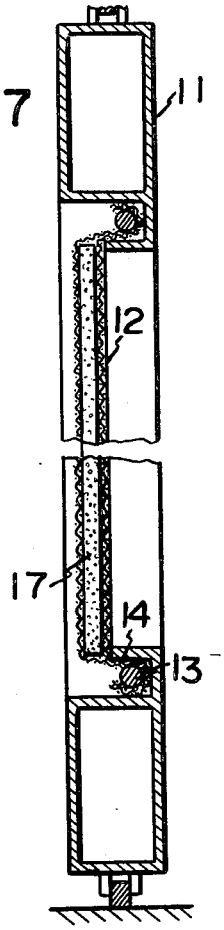
FIG. 8
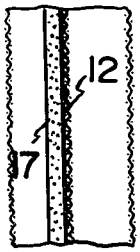
FIG. 9
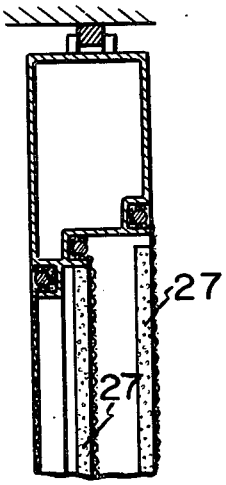
FIG. 10
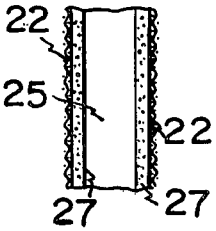
FIG. 11
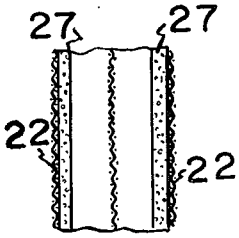
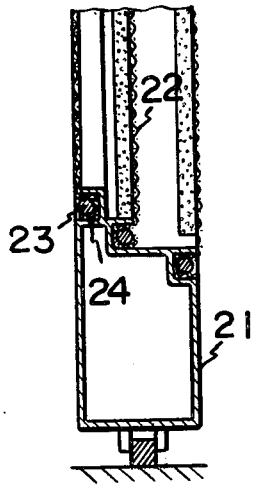

OBSERVATION OF THE AIR FLOW IN THE ROOM n mber of sereens 3
interval between each two screens 20mm
velocity of air flow. U∞ = 1.52 m/s
angle of air flow θ = 30°

WINDOW WITH VENTILATING CAPABILITY

BACKGROUND OF THE INVENTION

In cold weather all homes are heated to some extent. It is conventional to completely close doors and windows to keep rooms warm and to keep out the cold air. Closing the doors and windows in an air tight manner improves heat retention and this can be ensured by the use of steel or aluminum frames which are available for the construction of the windows and doors. However, room ventilation has become worse which has resulted in conditions which are harmful to health in addition to accidents caused by carbon monoxide poisoning.

Of course the above problems could be easily solved by the frequent opening and closing of the windows or doors. This is troublesome however and causes an acute drop of the room temperature wehreby the room must be reheated to stay warm which results in an increased heating expense.

After conducting great research and numerous experiments in order to find a solution to the above problems, the inventor has achieved the result of being able to keep the room warm during cold weather without decreasing the ventilation. This result can be achieved by attaching a plurality of ventilating screens to the frame of any type of conventional window.

Accordingly, it is an object of the present invention to provide a window which is characterized by a plurality of ventilating screens which are attached in parallel to the sash or the frame of the window at desired intervals.

BRIEF DESCRIPTION OF THE DRAWINGS

FIG. 4A and FIG. 4B are a longitudinal cross-sectional view and a transverse cross-sectional view of the window of the first embodiment taken respectively on line II—II and III—III of FIG. 3.

FIG. 6 is a front view of the window of a second embodiment of this invention.

FIG. 7 is a longitudinal cross-sectional view of the window of the second embodiment taken on line IV—IV of FIG. 6.

FIG. 8 is a partial view showing the screen and porous member of the second embodiment.

FIG. 9 through FIG. 11 are cross-sectional view showing the window of a third embodiment.

FIG. 16-1 to FIG. 16-6 are graphs which show the insulation effect of the window corresponding to the thickness of the window when the velocity of air flow and the temperature difference $\Delta t$ are coordinated.

FIG. 17-1 to FIG. 17-6 are graphs which show the insulation effect of the window corresponding to the thickness of the window when the velocity of air flow is coorinated with the temperature difference $\Delta t$ or the rate of temperature difference $\Delta t/\Delta t_o$.

FIG. 18-1 to FIG. 18-9 are graphs which show the insulation effect of the window corresponding to the number of screens when the velocity of air flow is coordinated with the temperature difference $\Delta t$.

FIG. 19-1 to FIG. 19-4 are graphs which show the insulation effect of the window corresponding to the number of screens when the interval between each two screens is cooridnated with the rate of the temperature difference $\Delta t/\Delta t_o$.

DETAILED DESCRIPTION OF THE INVENTION

This invention relates to a window which has a plurality of ventilating screens that are attached to the frame thereof at regular intervals wherein an air layer is formed between each two screens and the flow of the air which passes through the window and screens is restricted and produces the effect of insulation.

The definition of the window and the types of window will first be explained for a better understanding of the window of this invention which will be hereinafter disclosed in great detail.

The window comprises the casement or sash and the window screen which is attached to the window frame.

The types of window for which this invention is available are;

1. casement windows
2. horizontal windows
3. sash windows
4. fixed windows The ventilating windows of this invention are employed in such a way that a plurality of screens are attached to the sash of the window with the existing window pane remaining in place or two sets of the plurality of ventilating screens are attached to the frame of the fixed window and the existing window pane is eliminated. Net of 9 to 24 mesh (Tylers standard) is mainly used as the material for the ventilating screens. However the mesh of the net can be varied corresponding to the number of screens and the width of the interval between each two screens.

The embodiments of this invention are hereinafter disclosed with respect to the attached drawings.

FIRST EMBODIMENT

Figure 3:
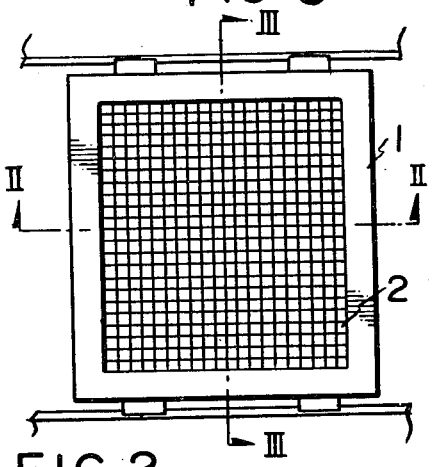
FIG. 3 is a front view of the window of the first embodiment of the present invention.
Figure 2:
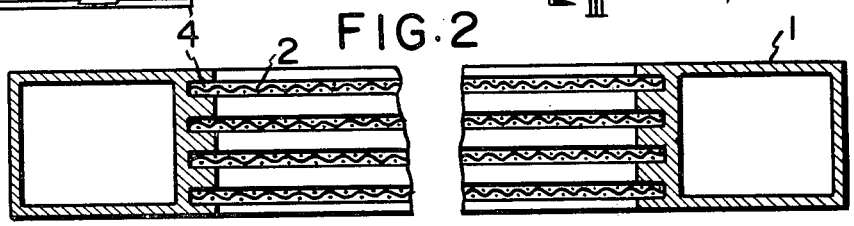
FIG. 2 is a longitudinal cross-sectional view of FIG. 1 taken on line I—I of FIG. 1.
Figure 4A:
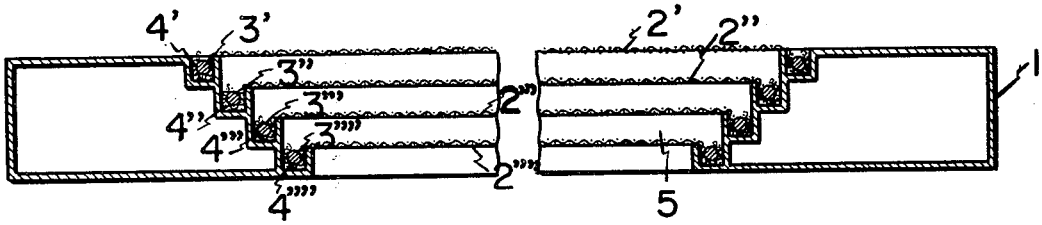
Figure 5:
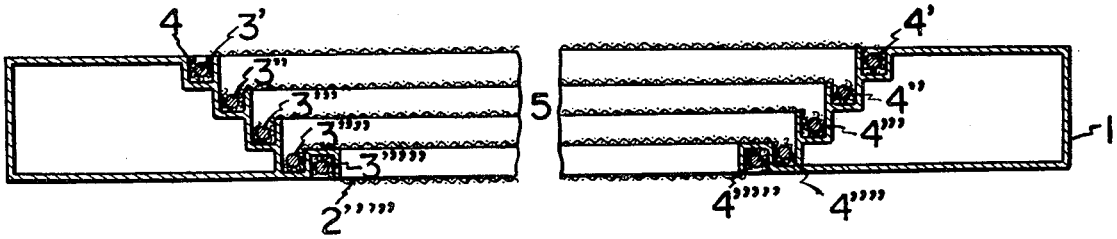
FIG. 5 is a longitudinal cross-sectional view which illustrates a modification of FIG. 4B.
Figures 2, 16:
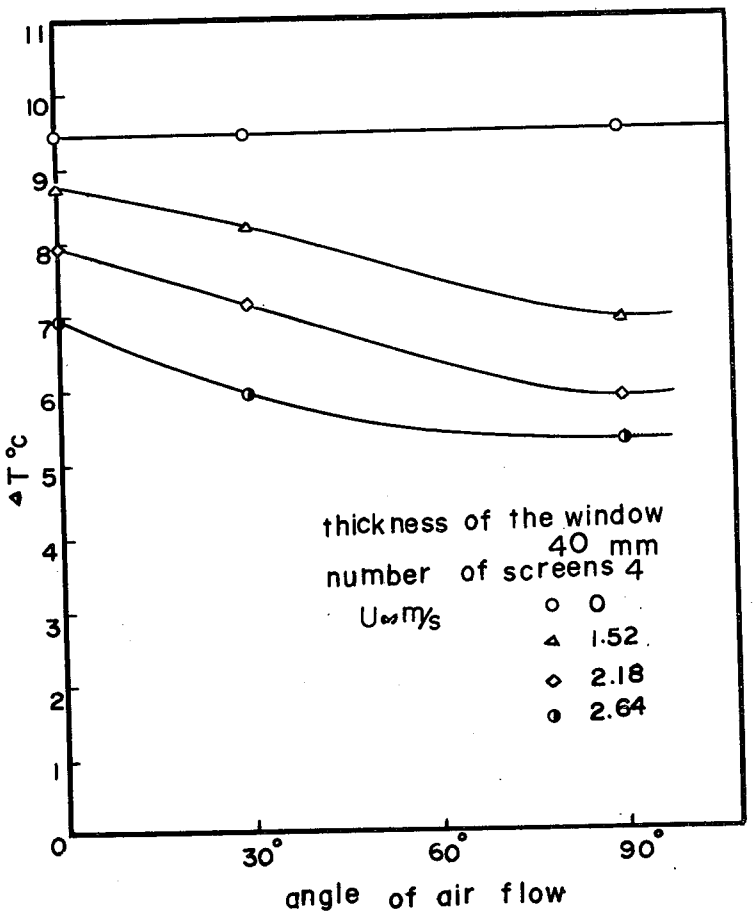
Figures 1, 16:
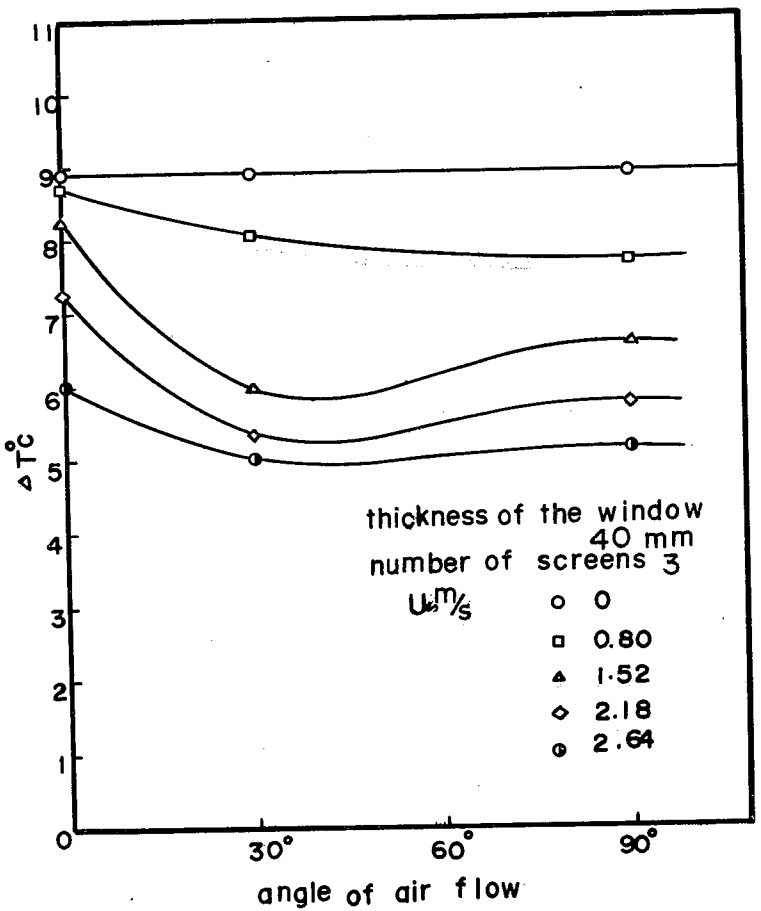
Figures 4, 16:
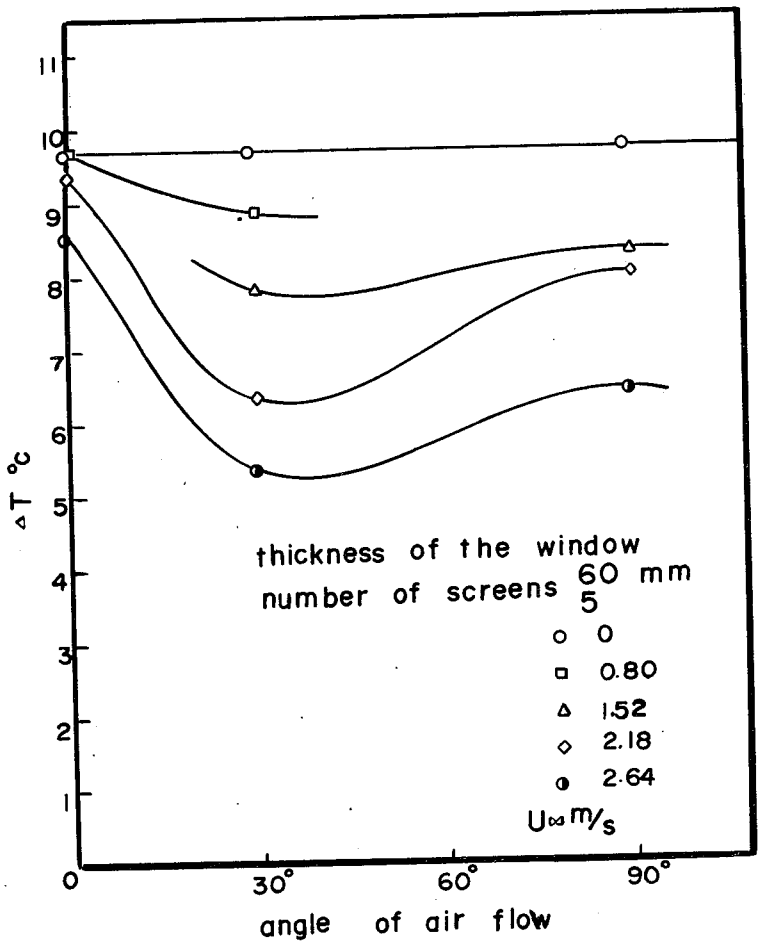
Figures 3, 16:
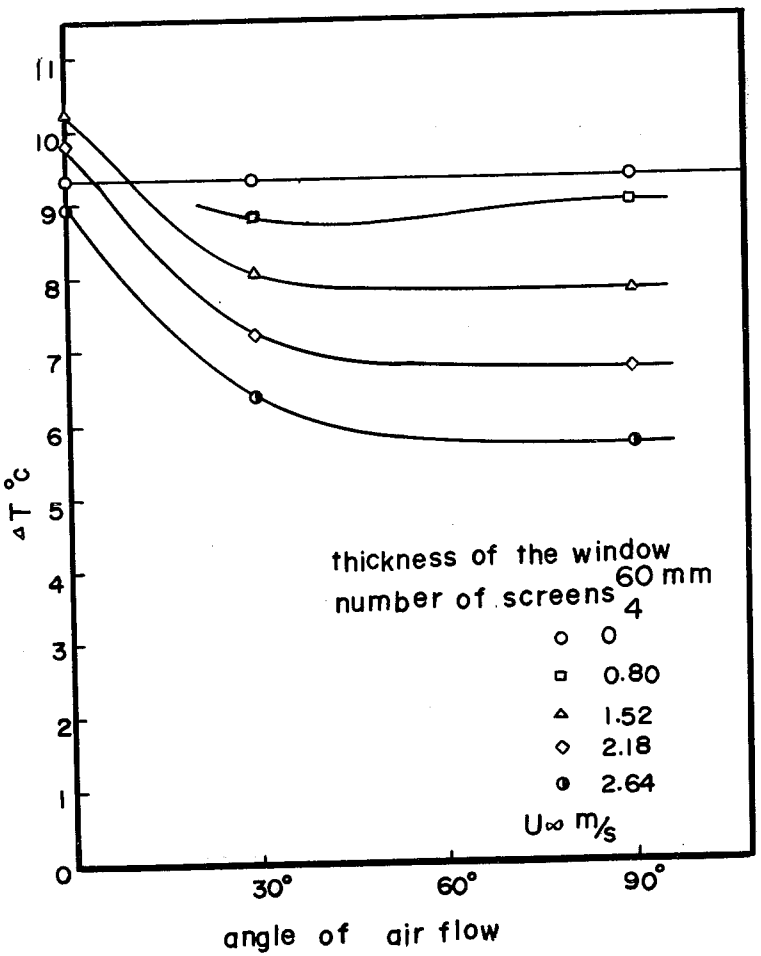

In FIG. 3 through FIG. 5 of the first embodiment of this invention, numeral 1 indicates a sash or casement, numerals 2', 2'', 2''', 2'''' indicate ventilating screens which are made of glass fiber net of desired mesh size, 3', 3'', 3''', 3'''' indicate retainer in this case a retaining bar by which the loosening of the above screens is prevented, 4', 4'', 4''', 4'''' indicate grooves into which the above retaining bars fit, numeral 5 indicates a vertical air layer which is formed between each two screens and works as a insulation layer to restrict the flow of air which passes through the window.

To inner periphery of the frame 1, the plurality of grooves 4', 4'', 4''', 4'''' are formed at regular and suitable intervals.

After the periphery of each side of the screen is inserted into each groove 4', 4'', 4''', 4'''' each flexible retaining bar 3', 3'', 3''', 3'''' which is usually made of vinyl chloride and has a U-shaped cross section is inserted into the respective groove 4', 4'', 4''', 4'''' in order to secure the periphery of the screen to the inner surface of the groove.

The manner in which a plurality of ventilating screens are assembled according to this embodiment is hereinafter disclosed.

First, the screen 2'''' is extended over the frame 1 and the entire periphery of the screen 2'''' is inserted into the groove 4'''' and is fixedly secured to the inner surface of the groove 4. A similar securing operation is performed with the other screens 2''', 2'', 2' in order to secure them in the respective grooves 4''', 4'', 4' at regular intervals thus forming the vertical air layer 5 between each two screens.

The window which comprises the plurality of ventilating screens has ventilating capability due to the manner of construction. A plurality of vertical air layers which are formed between the screens act as insulation between the inside and outside of the room whereby the room is kept warm or cool with little decrease in the ventilating ability of the window.

SECOND EMBODIMENT

Figures 6, 16:
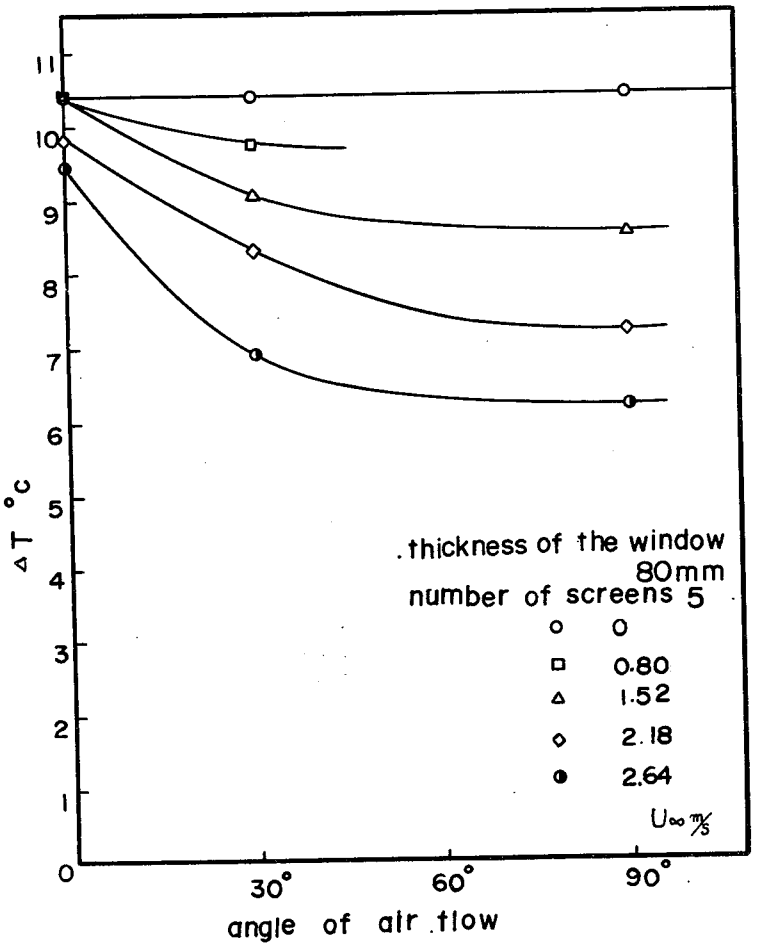
Figures 5, 16:
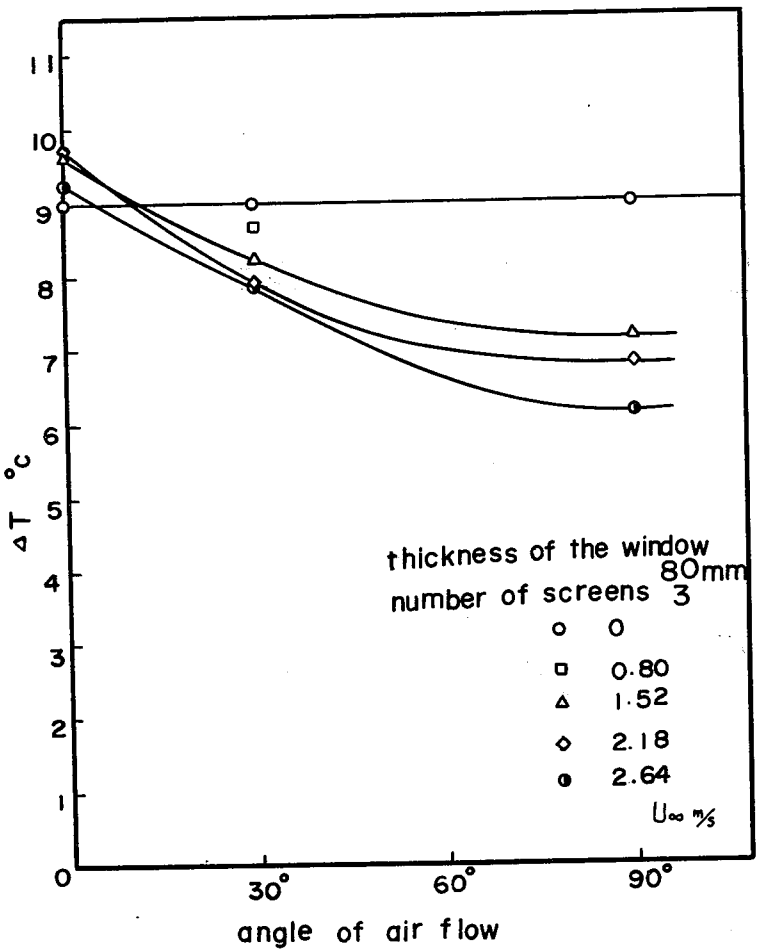
Figures 2, 18:
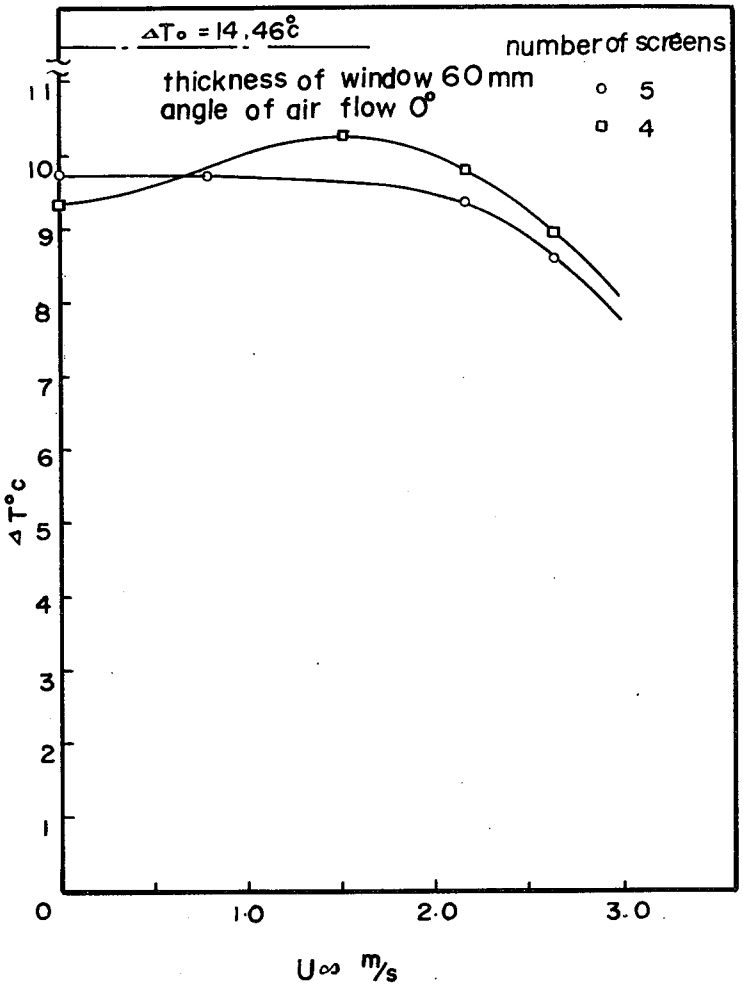
Figures 1, 18:
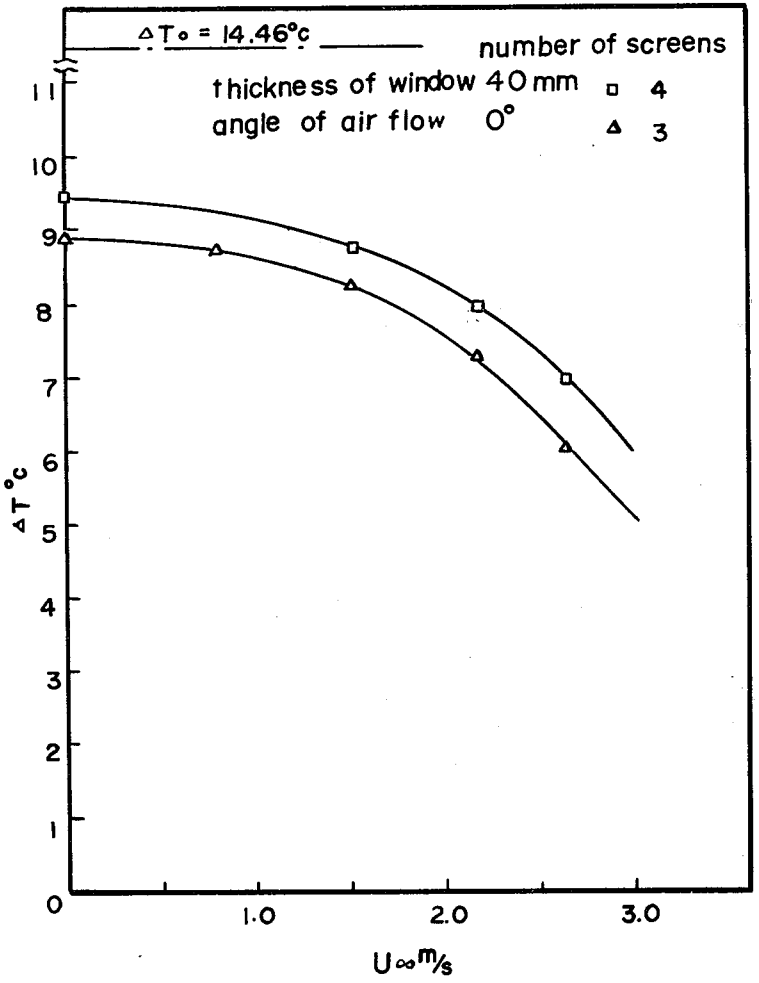
Figures 4, 18:
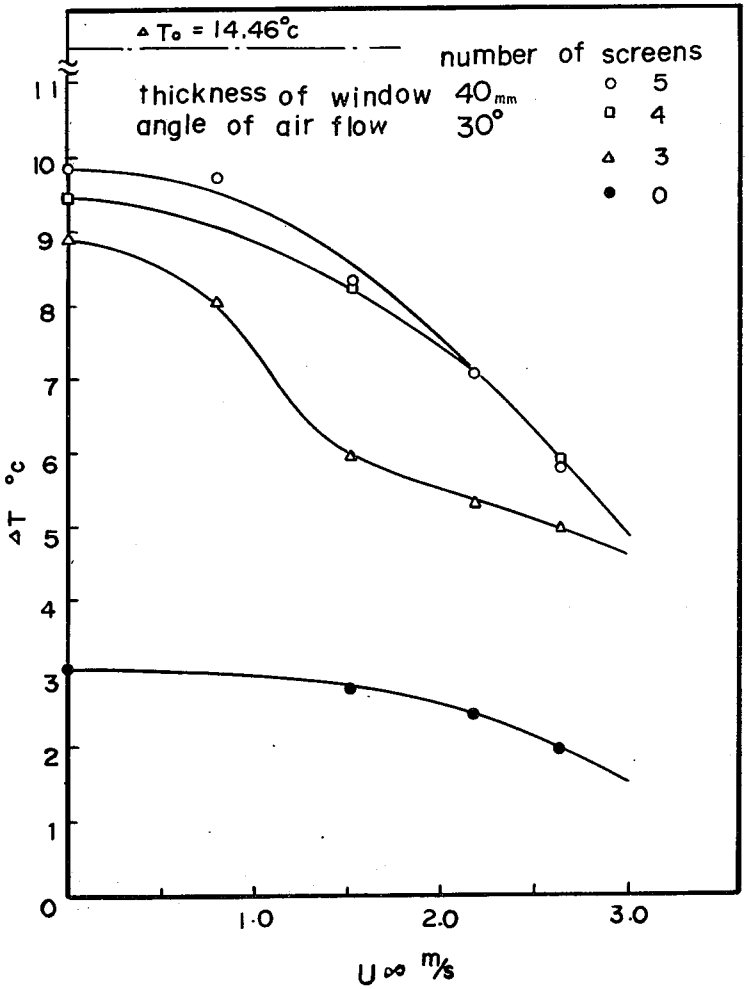
Figures 3, 18:
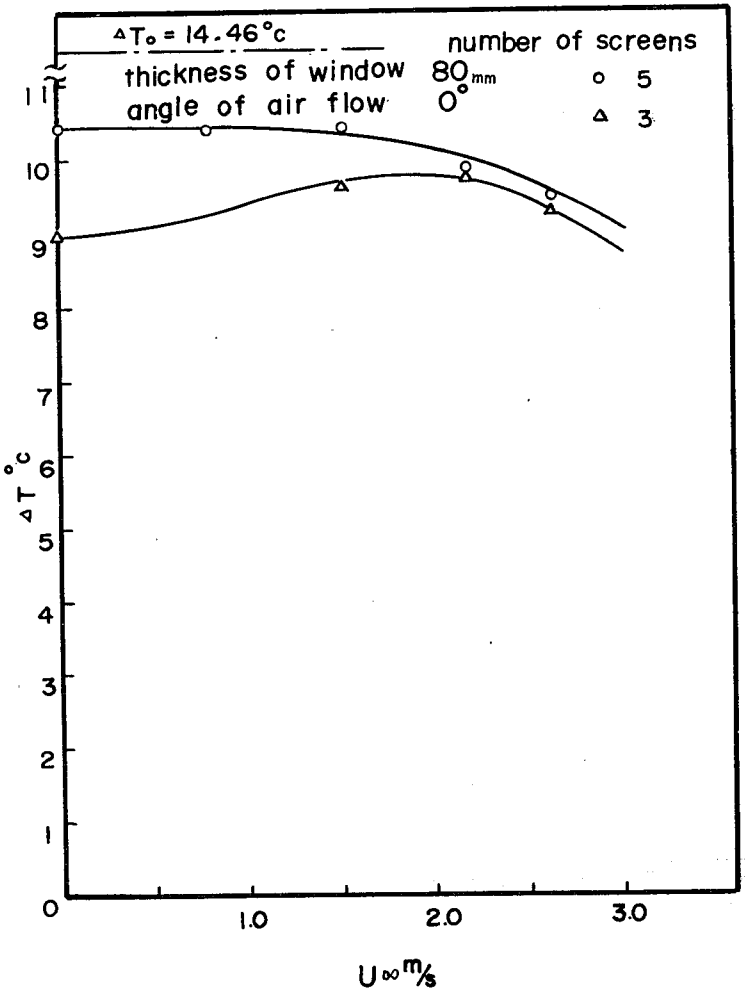
Figures 6, 18:
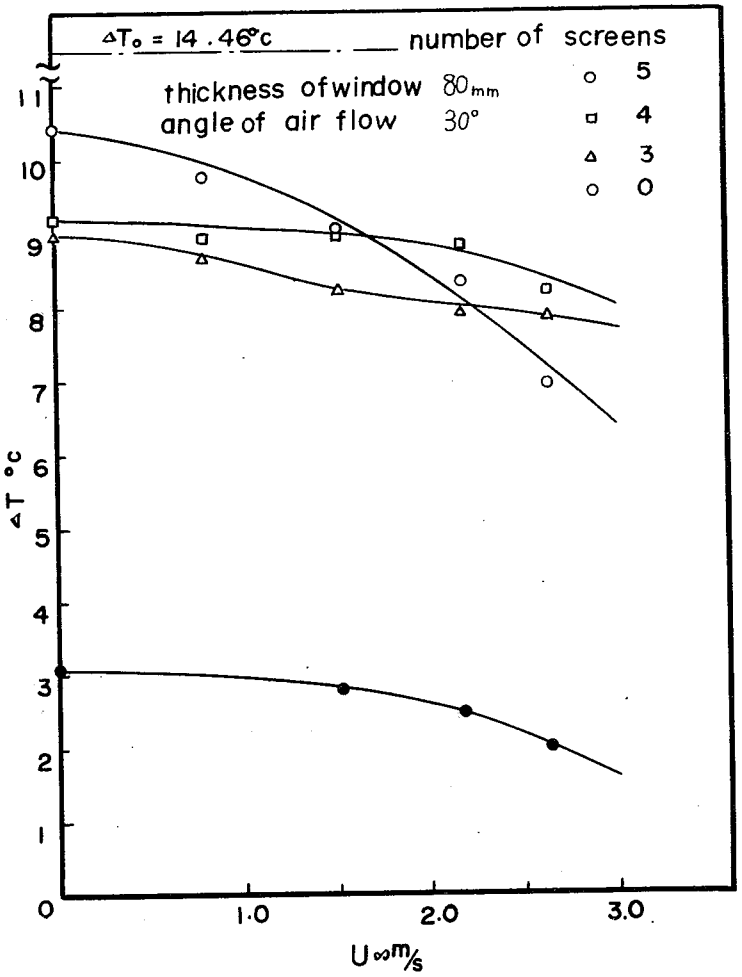
Figures 5, 18:
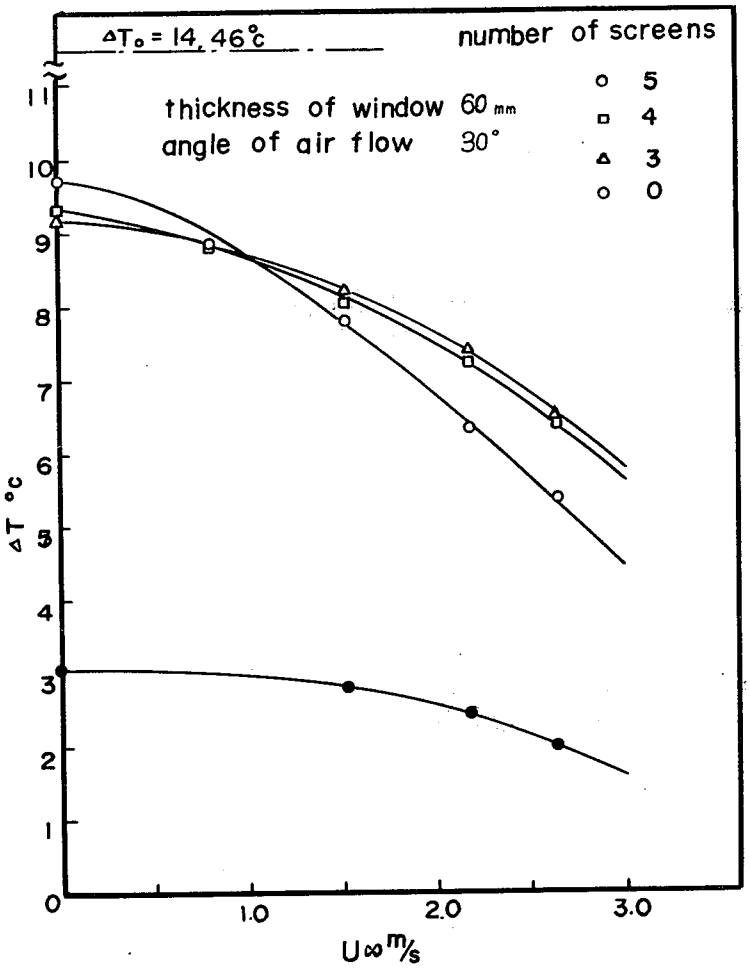
Figures 8, 18:
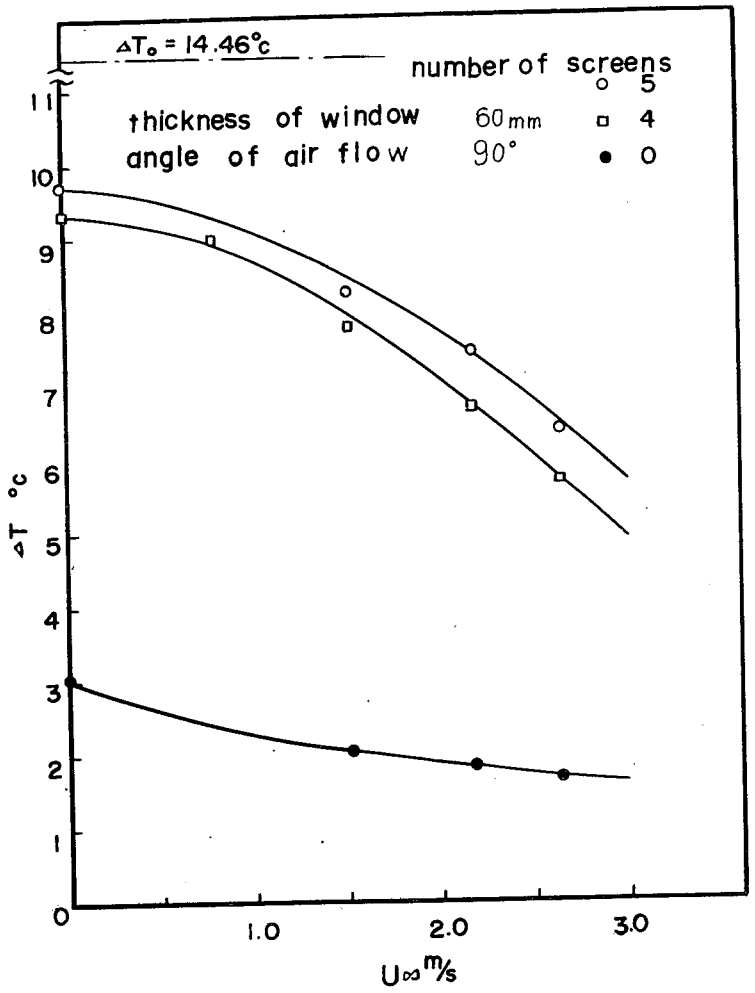
Figures 7, 18:
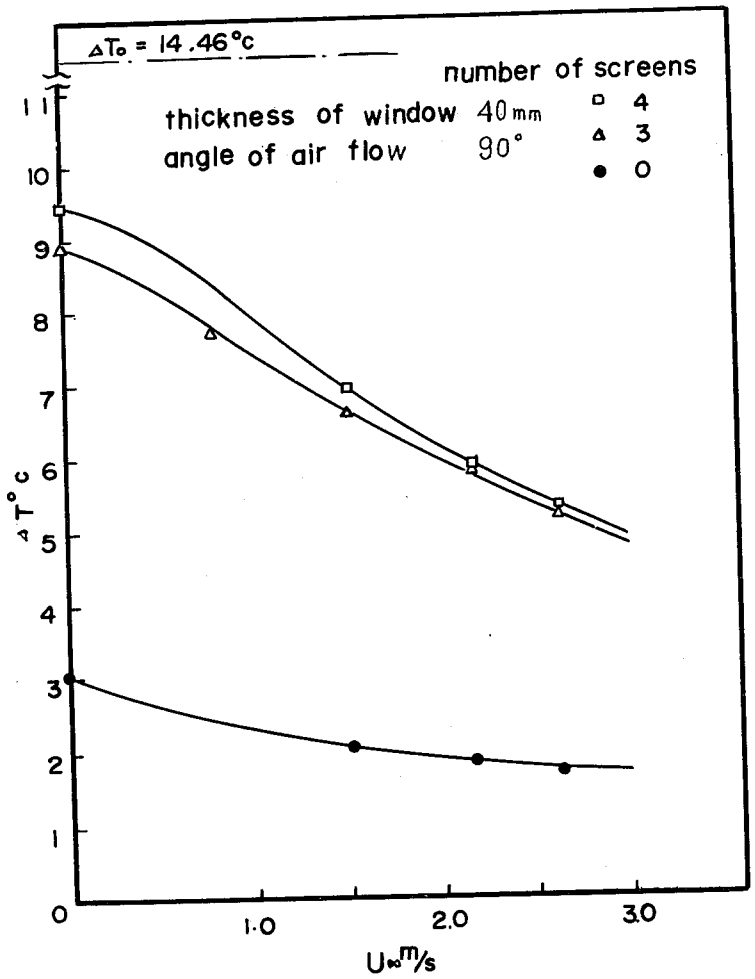

The second embodiment of this invention is shown in FIG. 6 through FIG. 8 and is characterized by a porous sheet 17 which receives more air flow resistance than a screen and which is attached to the screens of the window of the first embodiment.

Referring to FIG. 7, a porous sheet 17 which has a thickness of 1 – 5mm and which is made of urethane foam, glass fiber or the like and therefore permits air circulation is attached to the screen or screens by means of an adhesive agent which is coated over the entire surface of the screens. In general the mesh screen is made of the glass fiber.

There are two methods for securing the porous sheet 17 to the screens 12. In the first method, the periphery of the screen 12 is inserted in the groove 14, one side of the screen 12 is coated with the adhesive agent and then the porous sheet 17 is attached to the entire surface of the coated side of screen 12. In another method, before the periphery of the screen 12 is inserted in the groove 14, the adhesive agent is coated over one side of the screen 12 and then the entire periphery of the screen 12 with the porous sheet 17 attached to it is inserted into the groove 14.

The screen 12 to which the porous sheet is pasted is not necessarily the same as the screens which were used in the first embodiment but is one which is strong enough to bear the increased tension caused by the wind pressure on the porous sheet.

Since this second embodiment of the invention has the aforemention structure, the insulation capability of the window is obtained by the porous sheet in addition to that obtained by the air layer 5.

THIRD EMBODIMENT

Figures 9, 18:
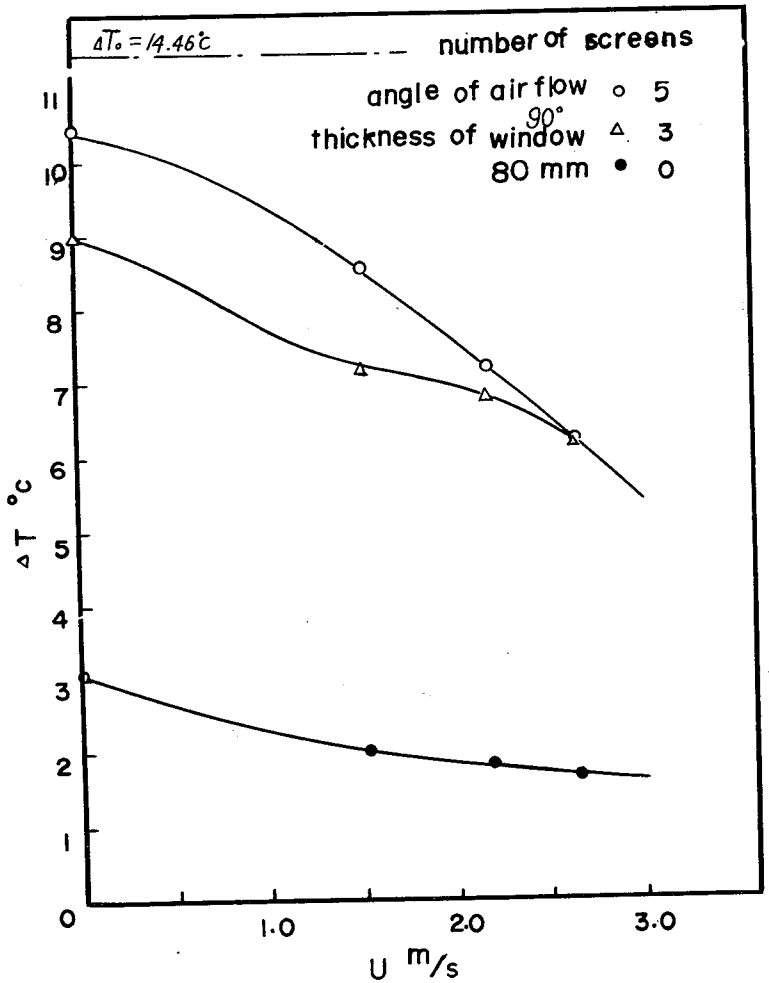

FIG. 9 through FIG. 11 show another embodiment of this invention wherein a plurality of screens with the porous sheet are disposed in parallel so that the insulation capabiltiy is further increased.

The superior insulating and ventilating performance of the window of this invention is further illustrated in the following reports of the experiments conducted at the mechanical engineering class of Ryukyu University of Japan.

THE EXPERIMENT RELATED TO THE INSULATING AND VENTILATING PERFORMANCE OF THE WINDOW OF THIS INVENTION

1. Presentation:

Gas, oil or electric heaters are conventionally available in homes as room heaters. Oil heaters have been widely used in recent years, however, some health considerations such as the positive exchange of the stale air in the room with fresh air are required.

A simple method for improving the ventilation while keeping the room warm is presented wherein a plurality of screens are secured to the window frame at regular intervals forming a layer of insulating air between each two screens.

This method utilizes the principle that a plurality of net screens which are secured to the frame of the window at regular intervals form insulating air layers between each two screens wherein the flow of air passing through the window encounters considerably greater flow resistance than would be the case where no such screens were attached. This method is characterized by the easy assembly and installation into existing window frames.

In illustrating the performance of a window with respect to heat retention and air flow or ventilation, the following conditions were decided and set up in advance of conducting the experiment.

A model room with a window of this invention on one side wall was constructed and the heat retention in the room and the air flow or ventilation of the room was examined.

The following report is the result of the experiments which were conducted following the above approach.

2. Model Room:

Model room is defined by the following items:

the material for the room: 100mm thick plywood inner volume of the room: 1.2mm × 1.2m × 1.2m = 1.728m$^3$ window size: 82cm × 100cm note: a double-glazed window was located on one wall of the room to inspect the room from the outside.

Styrofoamed plastic was used to cover the wall to ensure that there was no heat loss through this wall. The mean temperature of the room was determined by using an arithmetic mean calculation for the values of the twelve thermocouple thermometers which were disposed at desired places within the room. The experiment on the air flow which was observed is later discussed.

Figure 15:
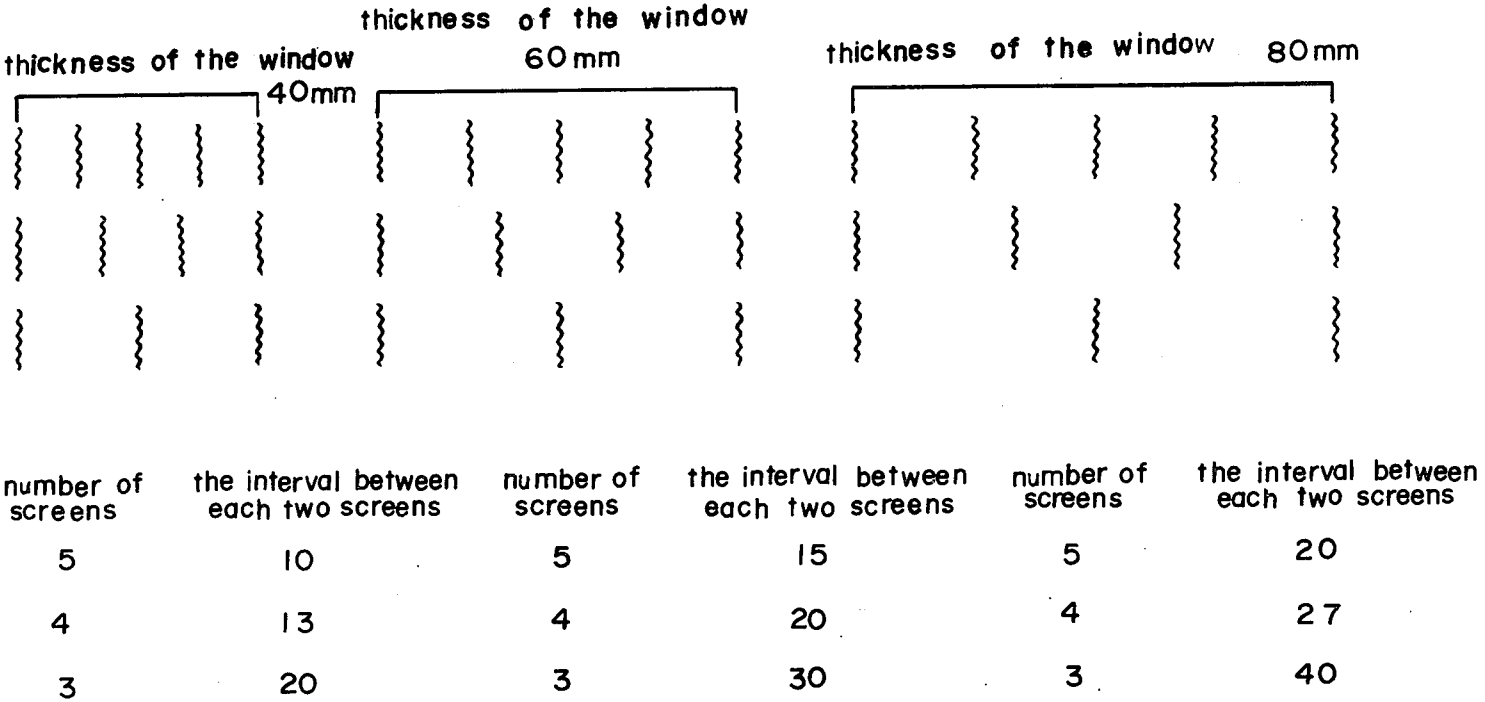
FIG. 15 is an illustrative view which shows the relationship between the thickness of the window, the number of screens and the intervals between each two screens.

3. Insulation Performance:

3-1. Conditions of Experiment;

In the model room where the heat source (voltage: 50V, current: 3.36A) was installed, it was reasoned that the mean temperature in the model room wound be subjected to the effects of the following parameters when air flow was encountered by the plurality of screens of the window.

a. number of net screens b. interval between each two screens c. velocity of the air flow d. angle of the air flow with respect to the window The experiment was conducted while considering the influence of the above items, a) through d), as well as the following reference on the velocity or angle of the air flow. With respect to the number of screens and the interval between each two screens, the values within the range as designated in FIG. 15 were employed. The following values were chosen for the velocity of the air flow and the angle of the air flow with respect to the window.

Velocity of the air flow

0 0.80 m/s 1.52m/s 2.18 m/s 2.64 m/s

Angle of the air flow with respect to the window

0 30° 90°

In order to obtain comparisions, the experiment was also conducted when the screens were removed as well as when the window was completely closed over with some suitable material after completely removing the screens.

3-2. Results and Conclusions

Figure 1:
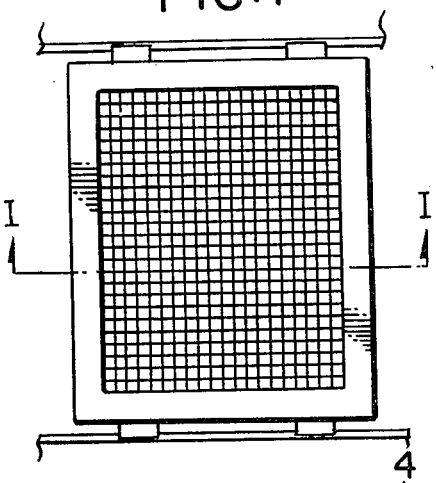
FIG. 1 is a general front view of a window of the present invention.

In FIG. 16-1 through FIG. 16-6, the velocity of the air is taken as the parameter with the angle of the air flow with respect to the window plotted an the abscissa and the temperature difference $\Delta t$ (the difference between the mean temperature in the model room and the temperature outside of the room)plotted on the ordinate. When the velocity of the air flow was, the temperature difference, $\Delta t$ tended to increase as the number of screens was increased. The insulating performance was therefore improved in each case where the thickness of the window was 40, 60 or 80mm. Furthermore, it was observed that the temperature difference, $\Delta t$ descreased until the angle reached 30°, but when the angle became more than 30°, the temperature difference, $\Delta t$ did not decrease corresponding to the increased angle of air flow. (See the plotted change of the temperature difference when the angle is 30 to 90°.)

It is reasoned that the flow resistance of the air which passes through screens may be influenced by the angle of the air flow with respect to the window, the number of the net screens and the intervals between each two screens.

Figures 2, 17:
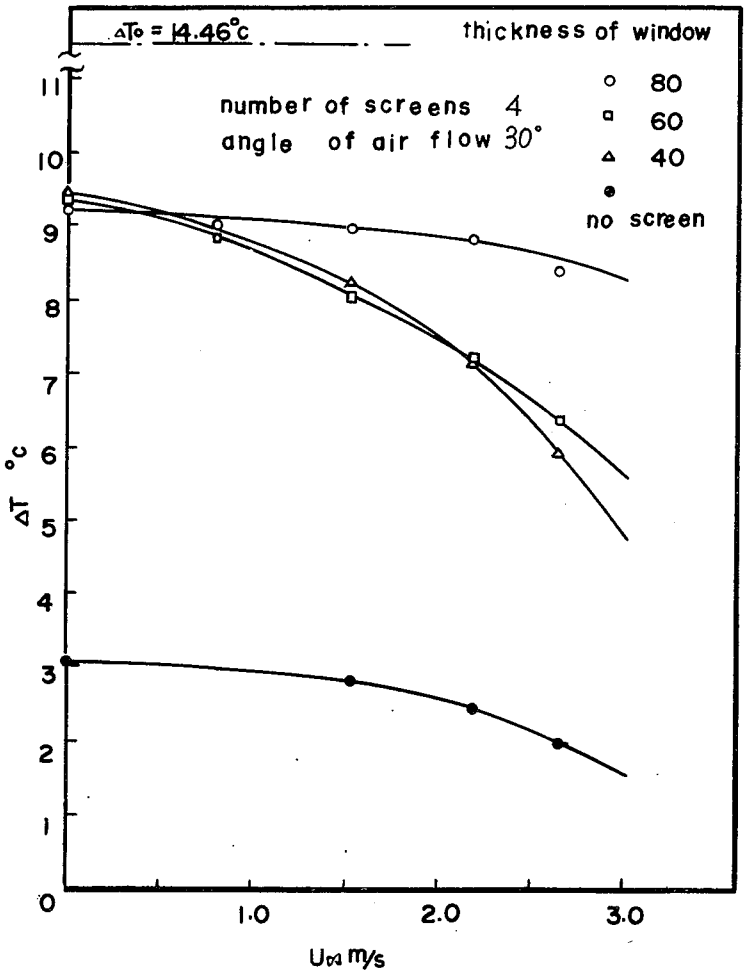
Figures 1, 17:
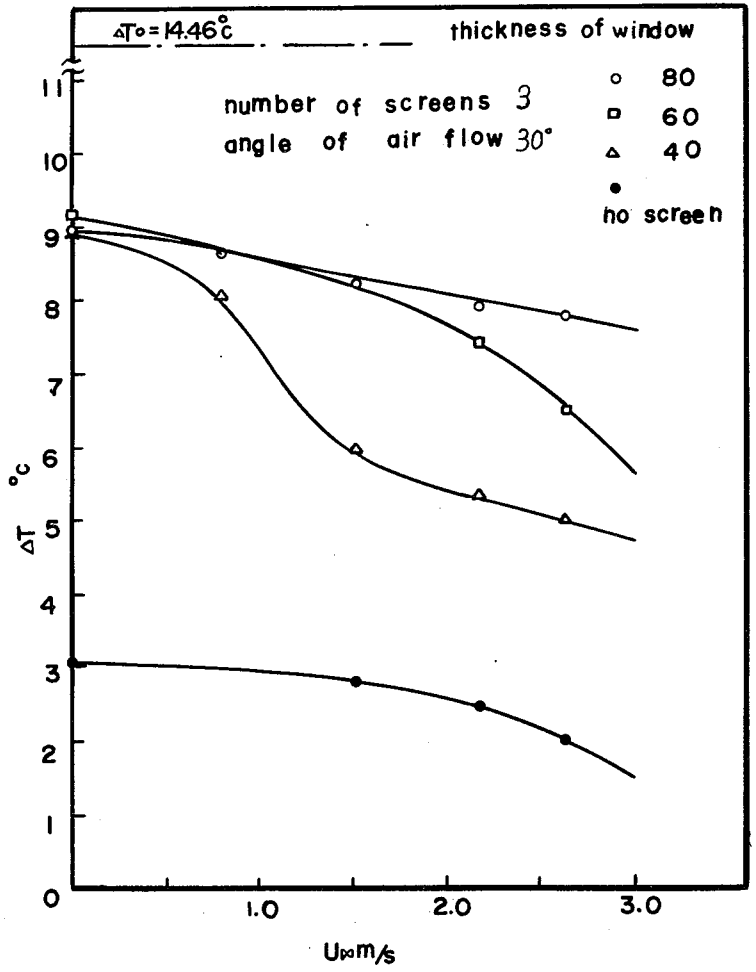
Figures 3, 17:
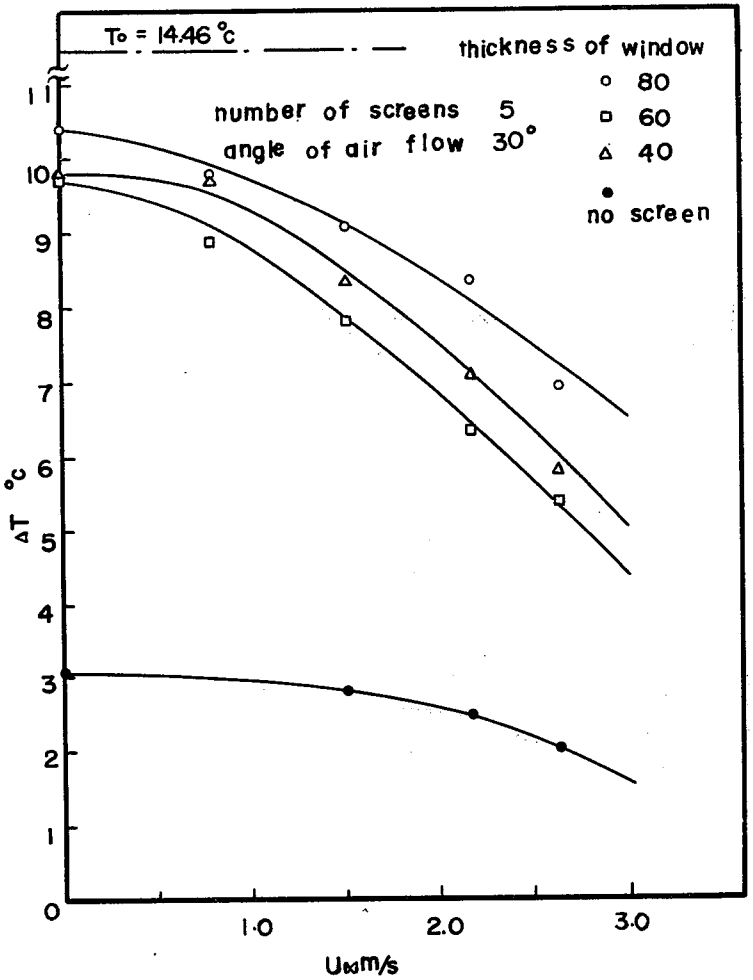
Figures 4, 17:
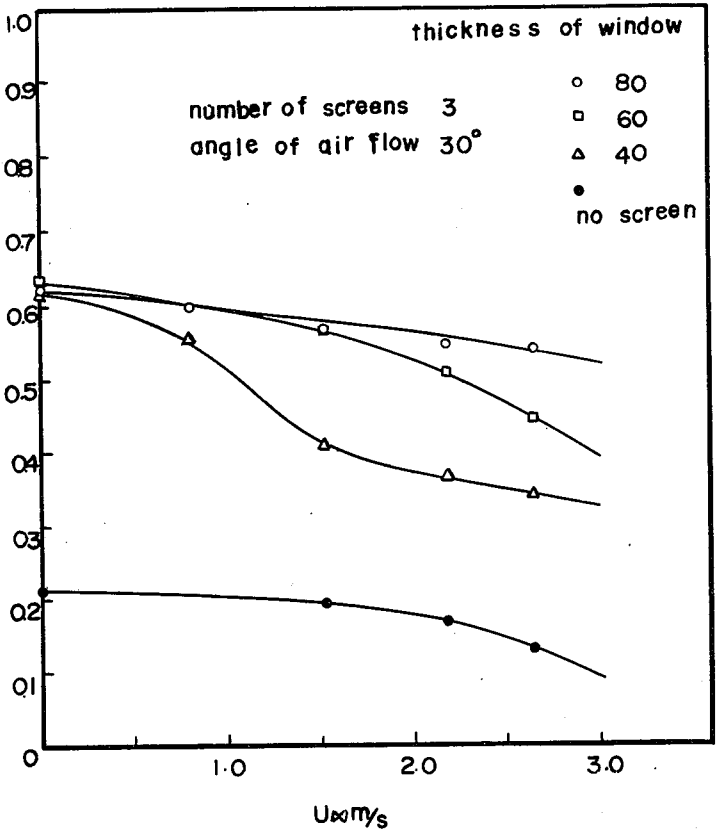
Figures 6, 17:
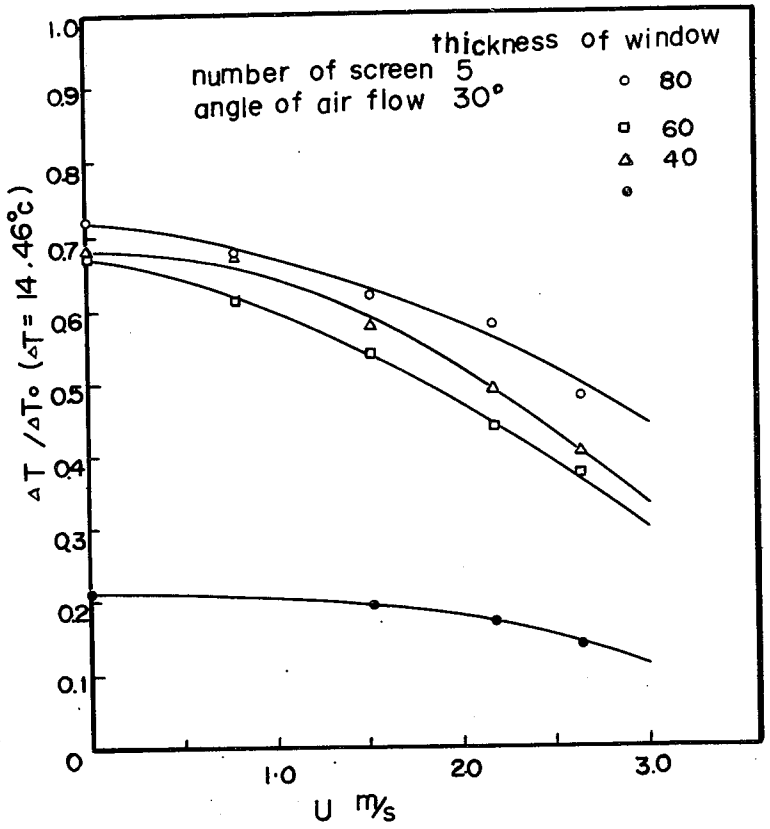
Figures 5, 17:
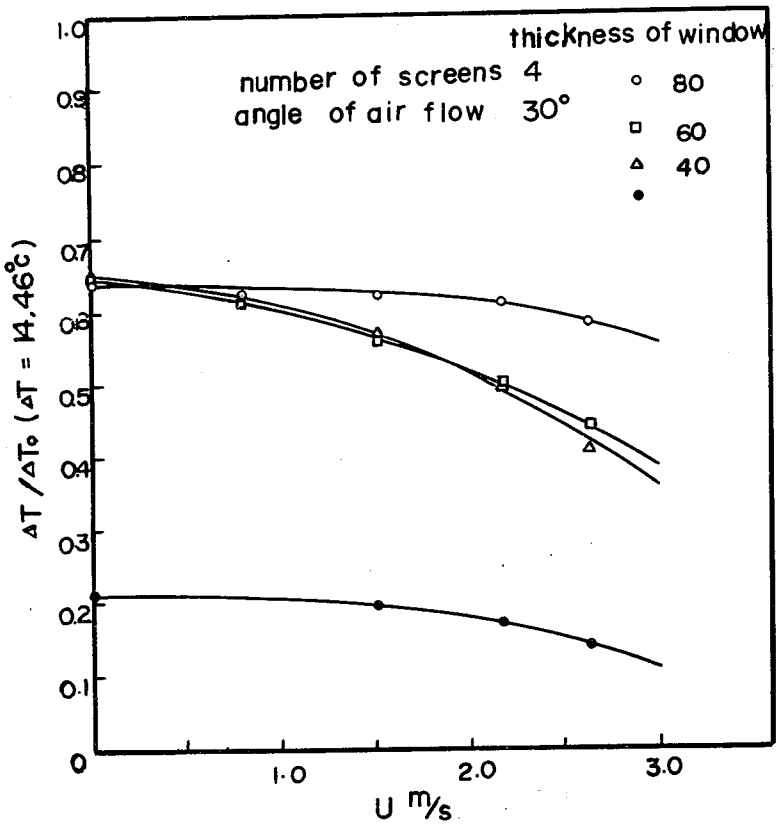

FIG. 17-1 through 17-3 indicate the change of the insulation effect, where the entire thickness, 40, 60 and 80 mm of the window is taken as a parameter with ∞ the velocity of the air flow plotted on the abscissa and the temperature difference, $\Delta t$ plotted on the ordinates. In the above Figures, the data obtained when the plurality of screens were completely removed and the data obtained when the window was completely closed over by a suitable means after the removal of the above screens are also plotted for comparison.

In FIG. 17-4 through FIG. 17-6, $\Delta t/\Delta t_0$ is nondimensional and shows the rate of the temperature difference between the experimental conditions when the screen of the window of this invention was in place and when the window was completely closed over. $\Delta t/\Delta t_0$ is plotted on the abscissa and the velocity of the air flow is plotted on the ordinate. The graphs indicate that the rate of temperature difference was the greatest in each case when the entire thickness of the window was 80mm and the number of the screens was three, four or five. When the number of the screens was three or four, the rate of temperature difference gradually decreased with the increase of the velocity of the air flow; when the number was five, the rate of temperature difference sharply decreased corresponding to the increase of the velocity of the air flow.

Compared to the temperature in the room when the room was completely closed, the rate of temperature difference was maintained between 55 and 60 percent when the number of screens was three or four and the entire thickness of the window was 80mm, while the rate of temperature difference fell sharply from 75 to 45 percent when the number of screens was five and the entire thickness of the window was 80mm. (When the screens were completely removed, the rate of temperature difference could be maintained only between 10 and 20 percent.) Throughout the above experiments the angle of the air flow with respect to the window was set at 30°. It is reasoned, however, that the above phenomena would be observed with greater or lesser angles based on the information given in the previous chart 16-1 to 16-6.

FIG. 18-1 through 18-6, the change of the insulation effect is shown and the number of screens is taken as a parameter with the velocity of the air flow plotted on the abscissa and the temperature difference plotted on the ordinate. The entire thickness of the window and the velocity of the air flow are fixed. The angle of the air flow was zero degrees throughout the charts and implies that the direction of the air flow was parallel to the surface of screens.

When the entire thickness of the window was 40mm or 60mm, the temperature difference changed greatly corresponding to the number of screens. When the above thickness was 80mm, the temperature difference changed only slightly with respect to the change in the velocity of the air flow but the absolute value of the temperature difference was greater than the cases where the thickness was 40 or 60mm.

When the thickness of the window was 80mm and the number of screens was three or four, $\Delta t/\Delta t_0$ was approximately 55 to 60 percent and this value was not greatly influenced by the velocity of the air flow (FIG. 18-6).

FIG. 18-7 through FIG. 18-9 present the data where the angle of the air flow with respect to the window was 90° implying that the direction of the air flow was at right angles to the surface of the screens. Although compared to the case where the angle of the air flow with respect to the window was 30° or 60°, the change of the temperature difference, $\Delta t$, relative to the change of the velocity of the air flow is sharp, no remarkable change of the temperature difference was observed with respect to the number of screens or to the entire thickness of the window.

Figures 1, 19:
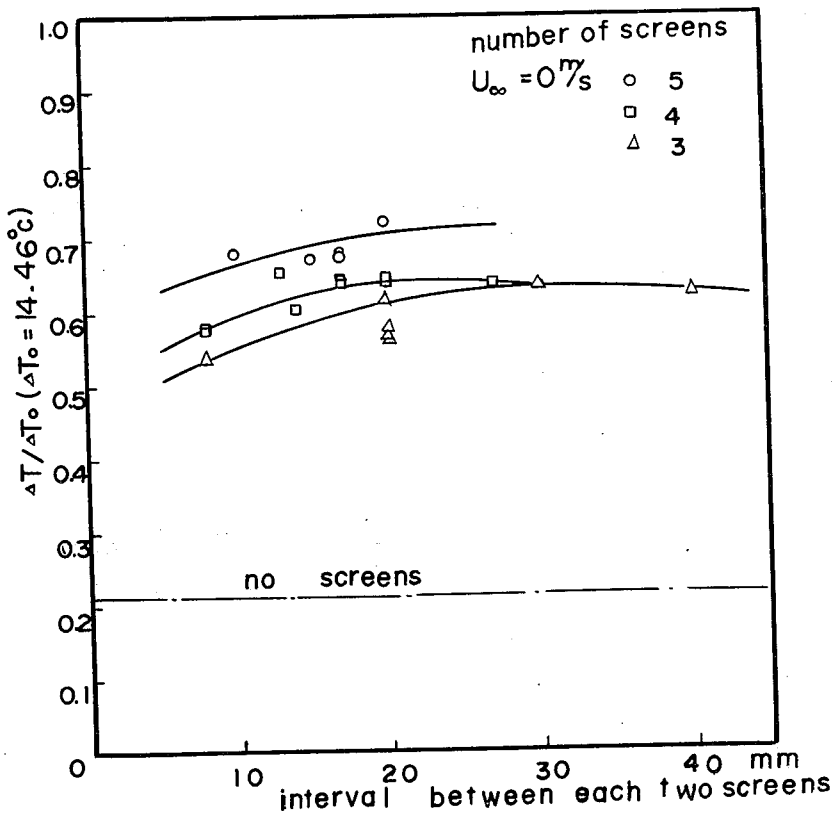
Figures 3, 19:
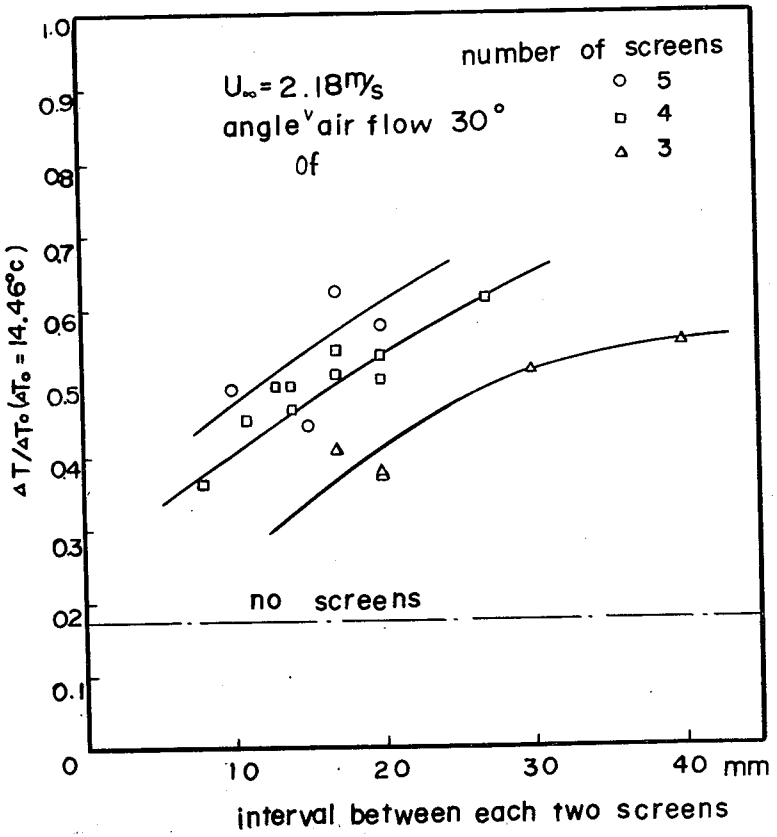
Figures 2, 19:
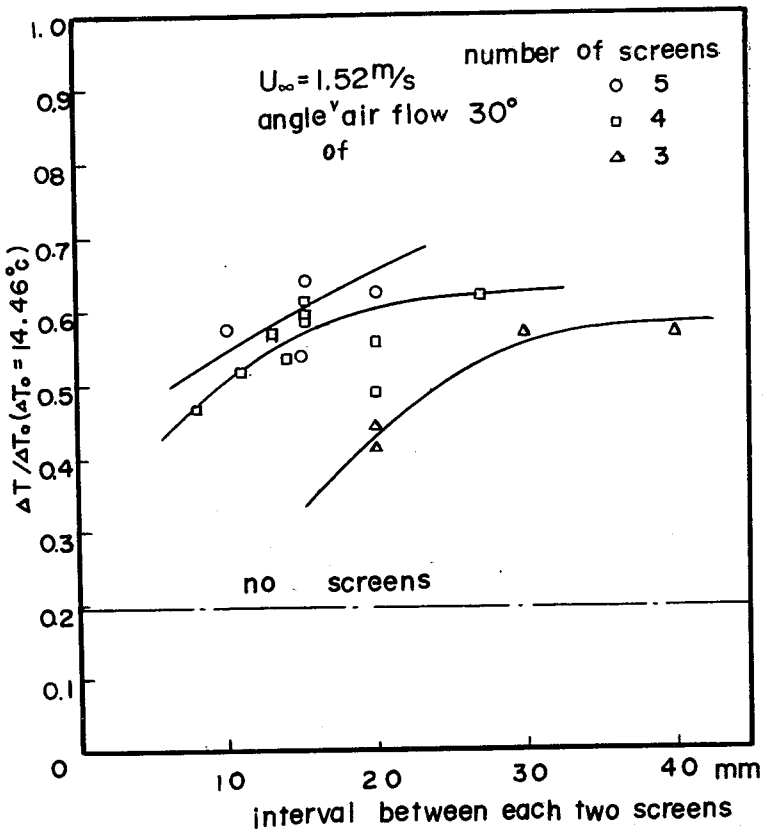

For the purpose of evaluating the experiments, FIG. 19-1 through FIG. 19-4 are presented wherein the number of screens were taken as a parameter with the interval between each two screens plotted on the abscissa and $\Delta t/\Delta t_0$ is nondimensional and shows the rate of temperature difference between the experimental conditions when screens of the window of this invention were in place and when the window was completely closed over ($\Delta t_0 = 14.46$ C). The velocity of the air flow was taken as a constant O, 1.52, 2.18 or 2.64 m/sec in FIG. 19-1 through FIG. 19-4. (The angle of the air flow was at 30° throughout.)

In the case where the screens were completely removed, $\Delta t/\Delta t_0$ gradually decreased within the range of 21 to 14 percent corresponding to the increase of the velocity of air flow. $\Delta t/\Delta t_0$ tended to increase corresponding to the increase of the interval between each two screens in all predetermined air flow velocities.

However, as can be clearly observed, the saturation phenomenon ($\Delta t/\Delta t_0$ approaches or forms an asymtotic curve to the constant value) is observed. It can be said within the scope of this experiment, that when the number of screens was three or four and the interval between each two screens was about 27mm or 40mm, respectively a notable insulating effect was observed as compared with the interval of other values.

Figure 20:
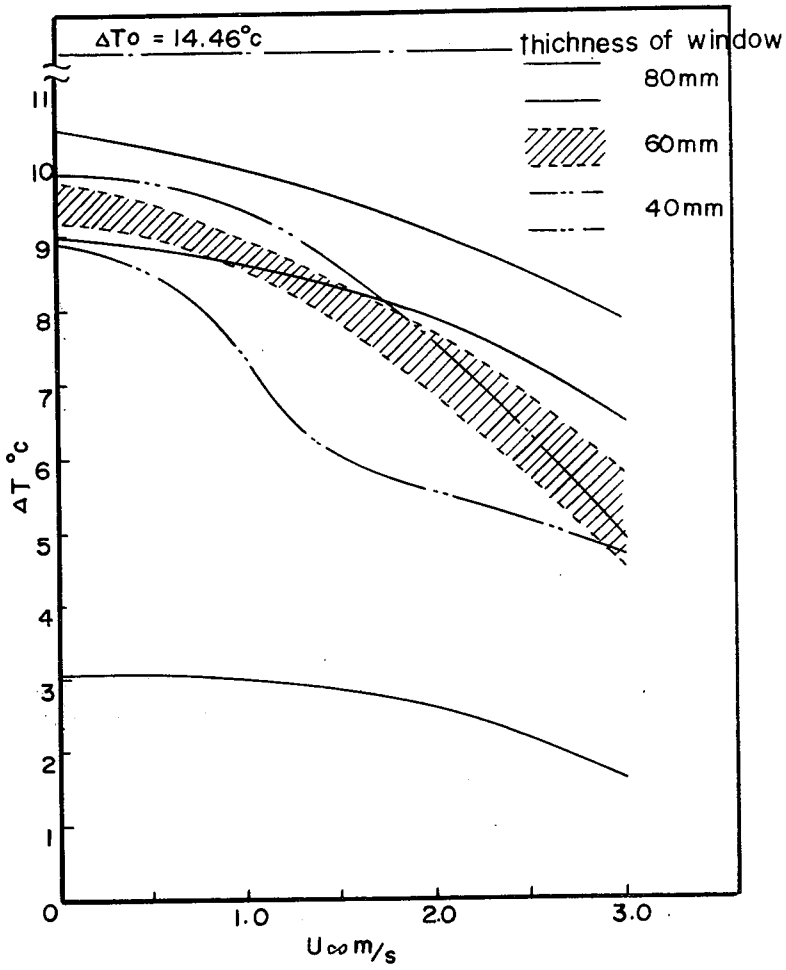
FIG. 20 is a graph which shows the insulation effect corresponding to the thickness of the window when the velocity of air flow is coordinated to the temperature difference $\Delta t$.
Figures 4, 19:
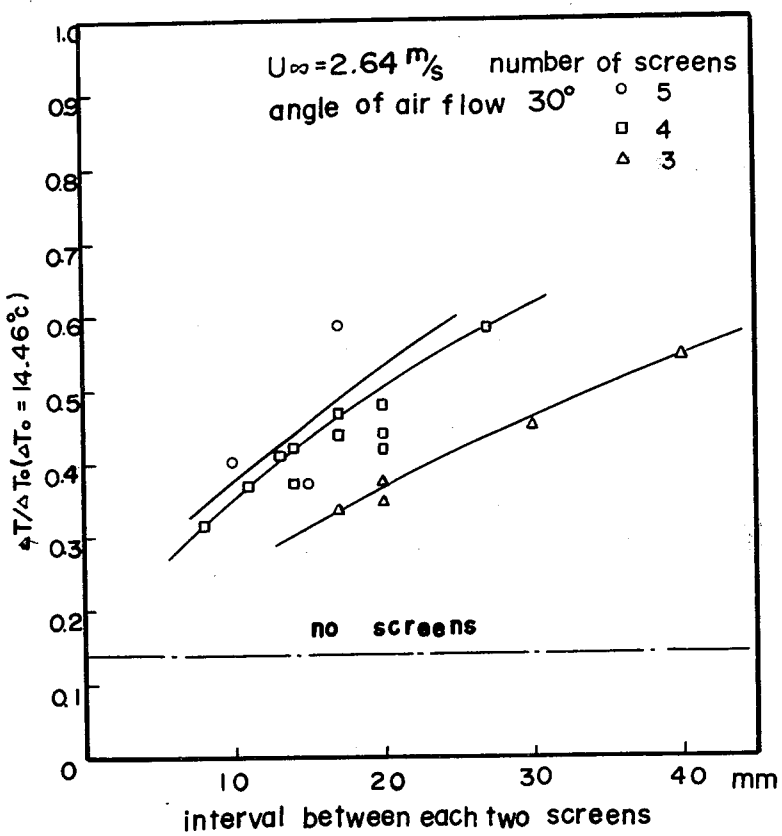
Figure 22:
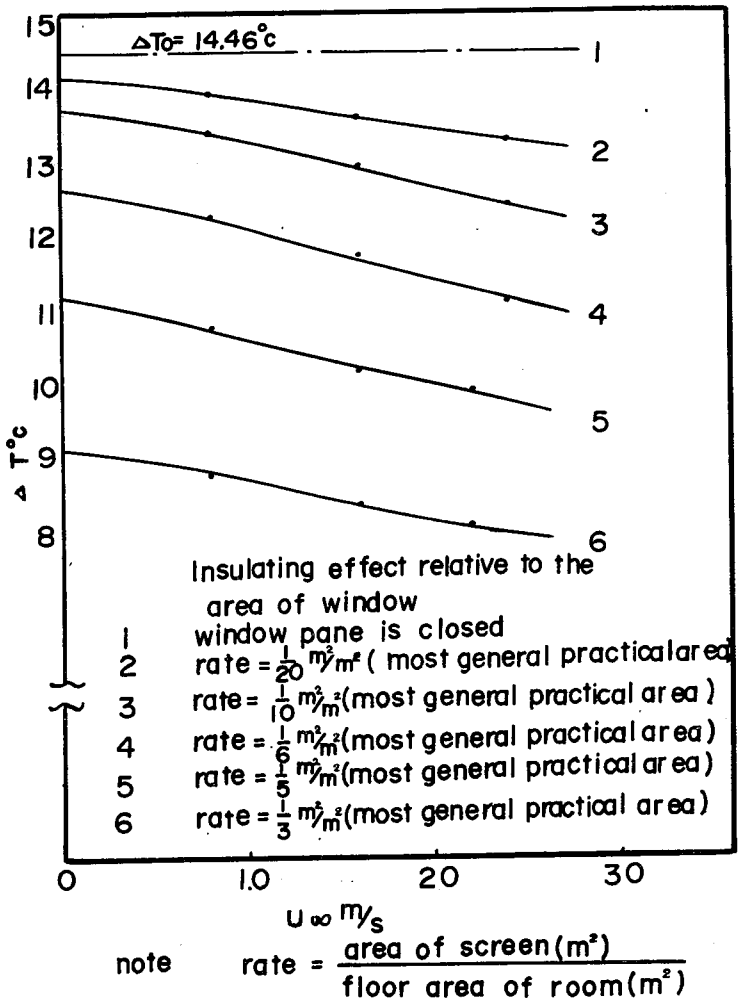
FIG. 22 is a graph which shows the insulation effect corresponding to the area of the screens when the velocity of air flow is coordinated with the temperature difference

In FIG. 20, the temperature difference, $\Delta t_0$ with respect to the velocity of the air flow is compositely shown wherein the entire thickness, 40, 60, 80mm of the window is taken as a parameter with ∞ the velocity of the air flow plotted on the abscissa and the temperature difference, $\Delta t$ plotted on the ordinate. As has been described in FIG. 1 with respect to the conditions of the experiment, the number of screens varied from three to five, the angle of the air flow with respect to the window varied and the entire thickness of the window also varied. All these changes and variables were taken into account in the drawing.

When the entire thickness of the window was 40 or 60mm, the temperature difference sharply decreased, corresponding to the increase of the velocity of the air flow. When the thickness was 80mm, the decrease of the temperature difference was more gradual and the temperature difference exceeded that of the thickness in the range where the velocity of air flow was high.

4. Conditions of Air Flow in the Model Room:

4-1. Observing the Flow of the Air.

The air flow in the model room, especially that of the fresh air which entered the room through the window of this invention and that of the inner air which left the room through the above window was clearly examined by the observation of the air flow.

4-2. Method of Observation.

The following provisional experiments were conducted before performing the air flow examination in order to determine the best method for the above examination.

a. Method using Valsan Rod V (article which is manufactured and sold by a Japanese pharmaceutical company) The method uses smoke caused by burning the above insecticide agent.

b. Method using ammonium chloride

This method uses a white smoke caused by the chemical reaction between hydrogen chlorde gas and ammonia gas.

$$HCl + NH_3 \rightarrow NH_4Cl$$

c. Liquid paraffin method

The method uses smoke caused by heating a wire which is coated with liquid paraffin.

d. Kerosene smoke method

The method uses a smoke caused by heating a wire which is coated with the kerosene.

e. Metaldehyde recrystalization method

This method is often used in observing the flow of gas in a combustion chamber of an internal combustion engine wherein the metaldehyde is first sublimated at a suitable temperature and is recrystallized in the chamber so that the crystallized particles are carried by the flow gas. These five methods were subjected to the provisional experiment and the results are disclosed as follows.

Although methods a) and b) produce a great quantity of smoke, they are not suitable for experiment because the smoke is poisonous and will have harmful effects on the human body if it is used for a long period. Method c) produces enough smoke which will be carried by even a weak air flow, therefore, it would be possible to take photographs. Although method d) was successful in producing smoke but it is dangerous because kerosene is combustible. Method e) produced recrystallized particles which were too big or heavy to be carried by the air flow. Therefore, method c) which uses a liquid paraffin was adopted.

4-3. Conditions necessary for the observation experiment.

Figure 21:
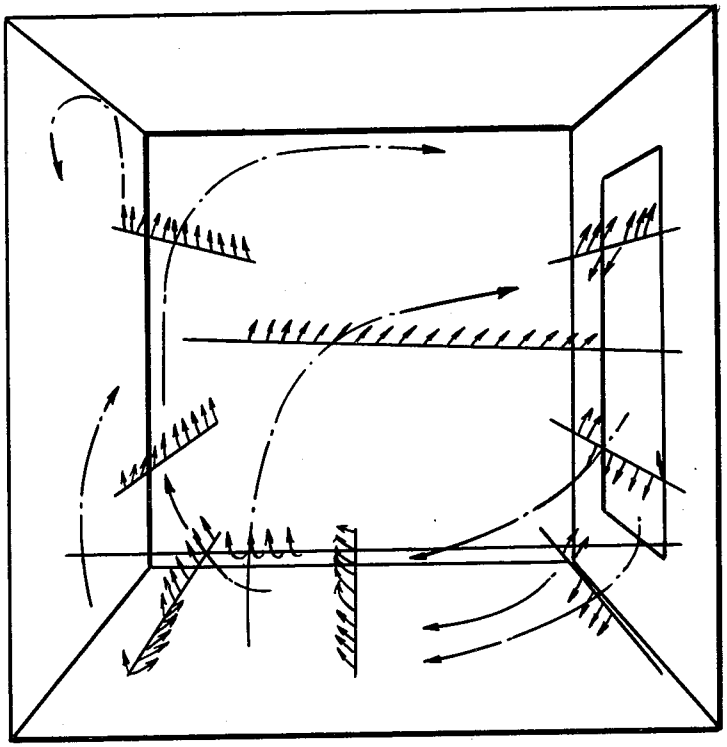
FIG. 21 is an illustrative view of the model room of the experiment which shows the air flow in the model room.

A Ni-Cr wire of a desired length was wrapped with rockwool and installed in each predetermined place of the room. The liquid paraffin was then applied to the above rockwool. The smoke was emitted from the rockwool when a voltage ranging from 30 to 40V was applied to the wire. The location of the heated wires is shown in FIG. 21. In this observation experiment, the number of the screens was set at three and the interval between the screens was set at 20mm. The angles of the air flow with respect to the window were 0°, 30° and 90°.

5. Conclusion:

After the experiments on the insulating and the ventilating capabilities of the window of this invention, where the number of screens (three, four and five) and the angle of the air flow with respect to the window (0°, 30°, 90°) were changed with the thickness of the screens (40, 60, 80mm) as the parameters, the following results were observed.

1. In each case where the number of screens was one of three predetermined numbers, the window having the thickness of 80mm proved to have the most favorable insulation capability where the temperature difference was between 55 and 68 percent of the difference where the window was entirely closed. When the screens were completely removed, the temperature difference was around 14 to 21 percent of the case where the window was entirely covered over (see FIG. 17-4 to FIG. 17-6). This means that when the number of screens was set at a constant number, as the width between each two screens was increased, i.e., as each insulating air layer became wider, a corresponding improvement in the insulating effect was noted.

2. In either experiment where the entire thickness of the window was 60 or 80mm and the number of screens was five, the insulating effect sharply decreased corresponding to the increase of the velocity of the air flow and furthermore, the insulating effect was less than when the number of screens is either three or four (see FIG. 18-4 to FIG. 18-6).

This means that when the entire thickness of the window was set at a constant value, the insulating effect was superior when the number of screens was four, less superior when the number was three and sharply decreased when the number was five. 3. In each experiment where the number of screens was one of the predetermined numbers, the insulating effect improved with the increase of the interval between each two screens and $\Delta t/\Delta t_0$ approaches or forms an asymptotic curve to the constant value. Especially, as in either case where the interval between each two screens was 40mm and the number of screens was three or the case where the interval was 27mm and the number was four, the insulating effect has proved to be greater than in other cases (see FIG. 19-1 to FIG. 19-4).

4). The change of the air flow condition with respect to the change of the velocity of the air flow which passes through the window, the angle of the air flow with respect to the window and the number of screens can be observed to a great extent around the window while the entire air flow within the room is little changed even though other conditions are changed or varied.

This means that natural ventilation occurs even when there is no wind outside the room and gradually become larger corresponding to the increase of the velocity of the air flow.

5). If the window area becomes smaller relative to the room floor area of 20 $m^2$ and a window area of 1 $m^2$, the temperature of the room when the window of this invention is used is only one degree Centrigrade lower than when the window is completely closed over by a suitable material.

According to this invention, natural ventilation of a room can occur during cold weather while the room is always kept warm due to the effects of the aforementioned designated construction.

There are several methods for the installation of this window such as:

1. Installing the window of this invention in a separate sash which is placed on a rail that is located to the outside of the rails of the conventional sliding windows in such a way that the window of this invention is slidably on a rail attached to the frame.

2. The window of this invention also can be fixedly secured to the frame in front of conventional window panes. Additionally, with the use of the windows of this invention, fuel consumption of heating devices can be minimized thereby saving energy resources and the insulation and ventilation of a room can be remarkably improved.

Figure 12:
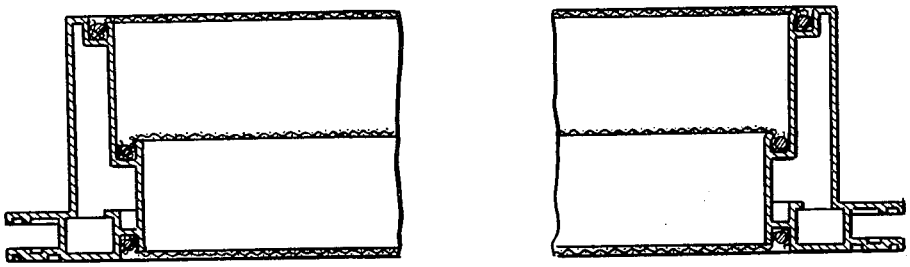
FIG. 12 to FIG. 14 are partial cross-sectional views illustrating modified shapes of sashes of the window.
Figure 13:
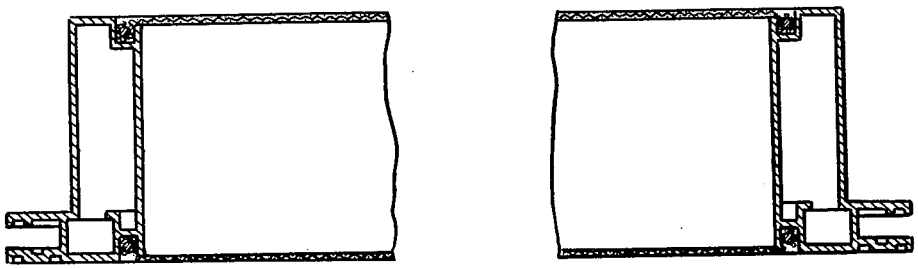
Figure 14:
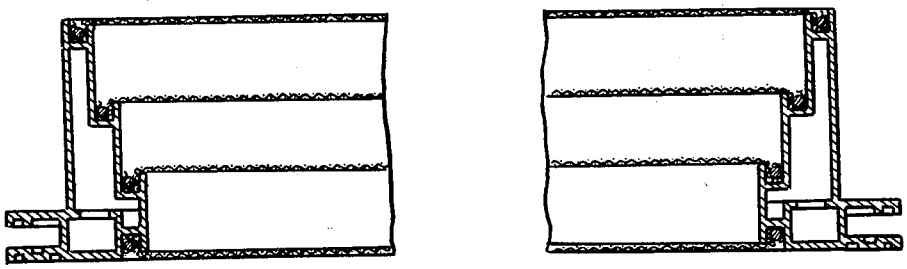

In FIG. 12 through FIG. 14, several types of shapes which can be used to form the casement or sash of the window of this invention are shown. Futhermore although the window of this invention has been disclosed with respect to insulating a room for warmth, those who are skilled in the art may easily understand that it is within the scope of the claim of this invention to use the window of this invention for the purpose of keeping the room cool in summer.

What is claimed is:

1. A window with a ventilating capability that does not decrease the insulating effect comprising a window sash, a plurality of net screens disposed within said sash at regular spaced intervals and forming insulating air layers between opposed pairs of net screens, a porous sheet material, adhesive means securing said porous sheet material to at least one side of at least one of said net screens, said window sash being provided with a plurality of grooves formed around the inner portion thereof, retaining bars accommodated with said grooves, said retaining bars securing the peripheral edges of said net screens within said grooves.

2. A window according to claim 1 wherein each net screen has a width having its opposite ends secured in corresponding pairs of grooves, said corresponding paired grooves being arranged in a tiered array, said net screen widths progressively decreasing relative to the thickness of said sash.

3. A window according to claim 1 wherein said net screens are made of glass fiber.

4. A window according to claim 1 wherein said porous sheet material is made of urethane foam.

5. A window according to claim 1 wherein said porous sheet material is made of glass fiber.

* * * * *